United States Patent [19]

Kunichika et al.

[11] Patent Number: 4,673,627

[45] Date of Patent: Jun. 16, 1987

[54] ELECTROPHOTOGRAPHIC LITHOGRAPHIC PRINTING PLATE

[75] Inventors: Kenji Kunichika; Yoshikatsu Kagawa; Chikashi Ohishi; Sho Nakao; Yasuzi Asao, all of Shizuoka, Japan

[73] Assignee: Fuji Photo Film Co., Ltd., Kanagawa, Japan

[21] Appl. No.: 813,329

[22] Filed: Dec. 26, 1985

[30] Foreign Application Priority Data

| | | | |
|---|---|---|---|
| Dec. 27, 1984 | [JP] | Japan | 59-273581 |
| Dec. 27, 1984 | [JP] | Japan | 59-273582 |
| Dec. 27, 1984 | [JP] | Japan | 59-273583 |
| Dec. 27, 1984 | [JP] | Japan | 59-273584 |
| Dec. 27, 1984 | [JP] | Japan | 59-273585 |

[51] Int. Cl.[4] ..... G03G 5/087; G03G 13/28

[52] U.S. Cl. ..... 430/49; 430/87; 430/127; 430/130; 430/135

[58] Field of Search ..... 430/49, 87, 127, 130, 430/135

[56] References Cited

U.S. PATENT DOCUMENTS

| | | | |
|---|---|---|---|
| 3,488,896 | 1/1970 | Makino | 430/127 X |
| 3,681,071 | 8/1972 | Donald | 430/87 |
| 4,296,190 | 10/1981 | Hasegawa et al. | 430/130 X |
| 4,357,403 | 11/1982 | Shimada et al. | 430/49 X |
| 4,383,020 | 5/1983 | Roberts et al. | 430/127 |

FOREIGN PATENT DOCUMENTS

| | | | |
|---|---|---|---|
| 0026384 | 4/1981 | European Pat. Off. | 430/130 |
| 2532245 | 3/1975 | Fed. Rep. of Germany | 430/130 |

*Primary Examiner*—Roland E. Martin

*Attorney, Agent, or Firm*—Sughrue, Mion, Zinn, Macpeak, and Seas

[57] ABSTRACT

An electrophotographic lithographic printing plate is described, comprising an electrically conductive support and a photoconductive layer on the support, said layer being made mainly of a photoconductive zinc oxide and a resin binder, wherein in the surface of the photoconductive layer, the degree of exposure of photoconductive zinc oxide is from 10% to 70%.

19 Claims, No Drawings

ELECTROPHOTOGRAPHIC LITHOGRAPHIC PRINTING PLATE

BACKGROUND OF THE INVENTION

The present invention relates to an electrophotographic lithographic printing plate, and more particularly to a lithographic printing plate which is improved in print staining.

A method for preparing a lithographic printing plate by the electrophotographic method is known. In general, an electrophotographic plate-making material bearing a photoconductive layer is uniformly charged, exposed imagewise and then wet or dry developed to form a toner image, which is then fixed. Thereafter, the material is treated with a desensitizing liquid or etching liquid to make non-image areas not bearing the toner image hydrophilic, whereupon a lithographic printing plate is obtained.

It is an essential requirement for a printing machine that ground contamination occurs less, but there is no printing machine fully satisfying this requirement. It is also required for a printing plate to be as free as possible from ground contamination and further to have a long press life. Conventional printing plates, however, fail to sufficiently satisfy the above requirements. For example, if the ratio of resin binder to zinc oxide particles in the photoconductive layer is decreased, the surface of the photoconductive layer is increased in desensitization properties, and ground contamination is reduced. On the other hand, the internal cohesive force of the photoconductive layer itself drops, that is, the mechanical strength becomes poor and the press life is shortened. On the contrary, if the ratio of resin binder to zinc oxide particle is increased, ground contamination is increased although the press life is increased.

Ground contamination is a phenomenon which appears on a whole printed paper and is correlated with desensitization properties of the surface of the photoconductive layer. While, spot contamination is one which appears spotted on a printed paper. The desensitization properties of the surface of the photoconductive layer are affected not only by the ratio of resin binder to zinc oxide in the photoconductive layer. Japanese Patent Publication No. 31011/75, Japanese Patent Application (OPI) Nos. 126406/74, 20735/79, and 68046/83, for example, describe that desensitization properties are effectively increased by changing or suitably choosing the type of the resin binder. The term "OPI" as used herein refers to a "published unexamined Japanese patent application".

Even if the resin binders described in the above-cited references are employed, ground contamination, spot contamination, plugging of dots, etc., and further, the press life are not sufficiently improved. In particular, ground contamination becomes marked in printing that utilizes color ink, which has been increasingly used in recent years. Moreover, if a number of plates are subjected to desensitization treatment by the use of an etching processor, the desensitization capability of the etching liquid is degraded, that is, contamination due to fatigue of the etching liquid sometimes occurs.

To reduce the ground contamination, a method of repeating treatment in an etching liquid which has been treated in an etching processor, that is, a so-called two-passage method, is known. It is empirically known that the two-passage method is effective in reducing ground contamination in a dot form. Thus when it is judged that ground contamination in a dot form would exert great influences on the value of printed matter, the two-passage method is often employed.

This two-passage method may be employed when the etching processor can be operated independently. However, in the case of an automatic print-making and printing system in which a plate-making processor and an etching processor, or an etching processor and a printer, or a plate-making processor, an etching processor and a printer are combined together into one assembly, the two-passage method using an etching processor is difficult to perform in practice. Thus with the use of automatic print-making and printing systems becoming more common, use of the two-passage method is often not possible from a practical viewpoint.

SUMMARY OF THE INVENTION

Thus, the objects of the present invention include providing an electrophotographic lithographic printing plate which is free from contamination not only over the whole surface (i.e., ground contamination), but also is free from contamination in a spot form even with only one-passage through an etching processor, which is resistant against the ground contamination due to color ink and the fatigue of an etching liquid, and is excellent in desensitization properties.

Another object of the present invention is to provide a lithographic printing plate which is resistant against friction and scratching, is free from damages due to careless handling and bad conveyance of an automatic print-making processor, and is easy to handle.

Still another object of the present invention is to provide a high quality lithographic printing plate which has a long press life and is good in reproducivility of half tone dots.

As a result of extensive investigations, it has now been found that if, in an electrophotographic lithographic printing plate comprising an electrically conductive support and a photoconductive layer made mainly of a photoconductive zinc oxide and a resin binder, the surface of the photoconductive layer is treated so that a degree of exposure of photoconductive zinc oxide on the surface of the photoconductive layer is at least 10%, the above objects can be attained.

Controlling the degree of exposure of zinc oxide in the surface of the photoconductive layer to at least 10% can be carried by a method of decreasing the resin binder ratio, a method of suitably controlling the viscosity of the monomer composition, a method of coating a photoconductive layer and then drying with humidized air to cause brushing, or a method of, after drying, applying glow discharge treatment, flame treatment, plasma treatment, electron beam, ion beam treatment, ultraviolet ray-irradiation treatment, ozone treatment, or other surface treatment. The particular treatment is not critical as long as the degree of exposure is at least 10%, but plasma treatment, corona discharge treatment, flame treatment, and electron beam and ion beam treatment on a surface of a photoconductive layer containing zinc oxide are preferable.

DETAILED DESCRIPTION OF THE INVENTION

The degree of exposure of zinc oxide in the surface of the photoconductive layer of the present invention can be determined by ESCA (Electron Spectroscopy for Chemical Analysis or X-ray photoelectron spectroscopy). The ESCA uses a surface-analysing apparatus in which photoelectrons which are released from the surface of a sample when it is irradiated with soft X-rays are measured for energy and intensity, whereby information concerning elemental analysis between He and U in the top surface layer and its bonding state can be obtained.

The degree of exposure of zinc oxide in the surface of the light-sensitive layer of the electrophotographic lithographic printing plate is represented by a spectral intensity of bare zinc oxide which is not covered by binder on a surface of photoconductive layer containing binder and zinc oxide, based on a spectral intensity of zinc oxide powder on a surface of photoconductive layer comprising only zinc oxide powder being 100, which can be determined by the following formula $$\text{Degree of Exposure of Zinc Oxide} = \frac{\text{Spectral Intensity of Zinc Photoelectron in the Surface of Photoconductive Layer}}{\text{Spectral Intensity of Zinc Photoelectron of Zinc Oxide Powder}} \times 100\ (\%)$$

That is, the degree of exposure can be determinined as a ratio of the intensity of the zinc photoelectron spectrum of zinc oxide in the surface of the photoconductive layer to the intensity of zinc photoelectron spectrum of zinc oxide powder. In this case, the measuring area on the surface of the photoconductive layer of zinc oxide and the printing plate is made constant, and treatment to prevent an increase of charge due to irradiation with X-rays, i.e., electrical earth treatment is conducted.

In the present invention, if a degree of exposure of photoconductive zinc oxide in the surface of the photoconductive layer is at least 10%, print contamination is reduced. Particularly, when the degree of exposure of photoconductive zinc oxide is in the range of from 15 to 70%, contamination due to color ink or a fatigued etching liquid is markedly reduced, and furthermore, degradation of press life is small. If, however, the degree of exposure is in excess of 70%, the press life is seriously decreased so as to be unsuitable for practical use.

The photoconductive layer of the electrophotographic lithographic printing plate is made mainly of a photoconductive substance and a binder. A lithographic printing plate is prepared by toner developing of the electrophotographic lithographic printing plate and then subjecting it to desensitization treatment to render the non-image areas hydrophilic. If zinc oxide in the non-image areas is covered with the binder and less exposed, the reaction with a desensitizing agent is retarded, and the non-image areas are not rendered hydrophilic. As a result, print contamination occurs.

The mechanism of improvement in desensitization by the plasma treatment in accordance with the present invention has not yet been made clear. The plasma treatment of the present invention is surface treatment using ionized air which is artificially produced. It is believed that when the photoconductive layer made mainly of a photoconductive substance and a resin binder is subjected to plasma treatment, the resin binder in the photoconductive layer is converted into low molecular weight compounds, or is decomposed or gassified by the action of various ionized active species produced in the plasma, so that a photoconductive layer in which the ratio of resin binder to photoconductive substance is substantially decreased results, and, therefore, desensitization is accelerated. When the treatment time is very short, e.g., not more than 90 seconds, especially not more than 20 seconds, only the top surface layer is treated. Even in this case, a sufficient increase in densitization is observed. Moreover, influences exerted on the adhesion to a toner image and press life can be greatly decreased without degrading the mechanical strength of the photoconductive layer as a whole.

In the plasma treatment of the electrophotographic lithographic printing plate according to the present invention, the treatment time is preferably as short as not more than 90 seconds, more preferably not more than 50 seconds and most preferably not more than 20 seconds, and moreover it is carried out in a dry manner. Thus, the plasma treatment is excellent for productivity.

In the plasma treatment of the present invention, glow discharge plasma, corona discharge plasma, arc discharge plasma, or plasma jet can be utilized. In particular, low pressure glow discharge using direct current or low frequency alternating current, high frequency discharge utilizing radio waves, and microwave discharge are suitable. The degree of vacuum is preferably in a range of from 90 to $10^{-2}$ Torr. A suitable amount of air, oxygen gas, or an inert gas such as nitrogen and argon may be introduced. An electrode system in which an electrode is provided inside a reactor, on a non-electrode system in which an outer load circuit is used may be employed. In order to increase the effect of the plasma treatment, the sample may be subjected to a pre-treatment of heating to about 100° C.

The corona discharge treatment of the present invention is the same as often industrially utilized for the purpose of improving surface characteristics of the plastic film or paper such as wetting properties and adhesion properties in which a high voltage is applied between electrodes (in many cases utilizing high frequency waves) at an atmospheric pressure to cause discharge and the plastic film or paper is irradiated with high speed electron ions. When a photoconductive layer made mainly of a photoconductive zinc oxide and a resin binder is subjected to the corona discharge treatment, the photoconductive layer is increased in wetting properties and permeability to the desensitizing liquid and thus desensitization is accelerated. Even if the treatment time is very short, e.g., not more than 90 several seconds, especially not more than 20 seconds, the influences on adhesion to the toner image and press life can be greatly reduced without degrading the mechanical strength of the whole surface of the photoconductive layer.

The corona discharge treatment of the present invention can be carried out in the air under atmospheric pressure. Thus the treatment equipment is simplified and economic, and the treatment time is short, preferably not more than 90 seconds, more preferably not more than 50 seconds and most preferably not more than 20 seconds. For this reason, the corona discharge treatment of the present invention is excellent in productivity.

Flame treatment in accordance with the present invention can be based on known flame treatment techniques. For example, as one of techniques to provide a polyolefin molding with good adhesion properties to printing ink or various coating material, a flame treatment, i.e., a method of exposing the polyolefin surface to flame of high temperature for a short time is described, for example, in U.S. Pat. Nos. 2,632,921 and 2,648,097 and Japanese Patent Publication No. 33057/80. Although the mechanism of improvement in desensitization when the photoconductive layer of the present invention, comprising a photoconductive zinc oxide and a resin binder is subjected to flame treatment has not yet been clear, it is believed that the resin binder in the surface of the photoconductive layer is partially oxidized by the action of flame, resulting in the formation of a photoconductive layer having a substantially decreased resin binder content and thus desensitization is accelerated. When the flame treatment is applied for a short time, e.g., not more than 90 seconds, especially not more than 20 seconds, only the top portion of the photoconductive layer is treated. Also in this case, sufficient improvement in desensitization is observed, and influences on the adhesion properties on the toner image or press life can be greatly decreased without degrading the mechanical strength of the photoconductive layer as a whole. In the flame treatment of the electrophotographic lithographic printing plate of the present invention, the treatment time is preferably as short as not more than 90 seconds, more preferably not more than 50 seconds and most preferably not more than 20 seconds, and it is carried out in a dry system. Thus, the flame treatment is excellent in productivility.

The electron beam or ion beam treatment that can be used in accordance with the present invention includes nuetral particle beam irradiation treatment.

As electron beam accelerators, a Van de Graf type scanning system, double scanning system, or curtain beam system can be utilized. It is preferred to employ the curtain beam system which is relatively inexpensive and produces a high output. In connection with electron beam characteristics, the acceleration voltage is from 100 to 1,000 KV and preferably from 100 to 300 KV, and the absorption dose is from 0.5 to 20-Mrad and preferably from 2 to 10 Mrad. If the acceleration voltage is less than 100 KV, the amount of energy transmitted is insufficient. On the other hand, if the acceleration voltage is in excess of 1,000 KV, the energy efficiency of the treatment drops, which is not economical. If the absorption dose is less than 0.5 Mrad, the effect of the treatment can be obtained only insufficiently. On the other hand, if the absorption dose is in excess of 20 Mrad, heat is undesirably generated in the material irradiated. In the ion ray irradiation treatment, a method of irradiating with an ion beam produced by an ion gun can be utilized.

As an ion beam source, inert gas such as He, Ne, Ar, Kr, and Xe can be used. Reactive gas such as $O_2$ can be added to increase the ion etching speed. Treatment conditions are determined by a product of a power (watt) (ion acceleration voltage x ion density $mA/cm^2$) and a treatment time. Preferably the power is from 0.05 to 0.75 $W/cm^2$, and the treatment time is from 1 to 15 seconds. If the power is in excess of the above range, changes due to an increase in the temperature of the photoconductive layer undesirably occur.

In a neutral particle beam treatment, the same ion beam source as above can be used. An electron shower is applied to an ion beam of acceleration voltage of from 1 to 25 KV to produce neutral particles which are applied for the treatment of the surface of the photoconductive layer. The treatment time is preferably from 1 to 200 seconds.

The mechanism of improvement in desensitization by irradiation with electron beam or ion beam according to the present invention is not completely clear. It is believed, however, that when the photoconductive layer of the present invention, which is made mainly of a photoconductive substance and a resin binder, is irradiated with electron beam, ion beam, and/or neutral particle beam, the resin binder is converted into low molecular weight compounds, or decomposed, resulting in the formation of a photoconductive layer having a substantially decreased resin binder content, and thus desensitization is accelerated. If the treatment time is very short, e.g., not more than 90 seconds, especially not more than 20 seconds, the mechanical strength of the photoconductive layer is scarcely decreased, and adverse influences on adhesion to the toner image and press life can be greatly improved.

Since in the electron or ion beam irradiation treatment of the present invention the treatment time is preferably as short as not more than 90 seconds, more preferably not more than 50 seconds and most preferably not more than 20 seconds, and the treatment is carried out in a dry system, productivity is high.

Supports which can be used in the present invention include electrically conductive metals such as aluminum, zinc, iron, and copper, and an electrically conductive base paper which has been used in electrophotographic light-sensitive materials. For example, a paper impregnated with ion conductive substances, or electron conductive substances such as inorganic metal compounds and carbon as described in U.S. Pat. No. 3,597,272 and French Patent No. 2,277,136, or incorporated with the above compounds during paper-making, a synthetic paper as described in Japanese Patent Publication Nos. 4239/77, 19031/78, and 19654/78, and a paper having one or both sides thereof laminated with polyolefin with a photoconductive substance incorporated as described in Japanese Patent Application (OPI) No. 57994/83 can be used.

In addition, a support comprising an insulative film of e.g., polyethylene terephthalate, polyvinyl chloride and cellulose acetate with metal such as aluminum or metal oxide such as indium oxide and tin oxide vacuum deposited or laminated thereon, a support prepared by laminating a polyolefin film with carbon black, for example, incorporated therein as described in Japanese Patent Application (OPI) No. 57994/83, and a support prepared by providing a film surface with electric conductivity by coating an electrically conductive substance such as CuI can be used. Any supports which (or the surface of which) are made substantially electrically conductive can be used.

The photoconductive layer to be provided on the above support comprises a photoconductive substance and a binder. A preferred example of the photoconductive substance is zinc oxide. In addition, other photoconductive substances such as cadmium sulfide and titanium oxide can be used. As the binder, a silicone resin, polystyrene, polyacrylate or polymethacrylate, polyvinyl acetate, polyvinyl chloride, polyvinyl butyral and their derivatives can be used. Particularly preferred is a combination of photoconductive zinc oxide and polyacrylate or polymethacrylate. The weight ratio of the photoconductive substance to the binder is in the range of from 3/1 to 20/1. If necessary, a sensitizing agent, a coating aid commonly used in coating, and the like can be added. The thickness of the photoconductive layer is suitably between 5 and 30 $\mu m$.

In a preferred embodiment of the present invention, an intermediate layer is further provided between the support and the photoconductive layer.

The resin that is used in preparation of the intermediate layer is not critical. For example, polyethylene terephthalate, polyimide, polycarbonate, polyacrylate, polymethyl methacrylate, polyvinyl fluoride, polyvinyl chloride, polyvinyl acetate, polystyrene, a styrene-butadiene copolymer, polymethacrylate, a silicone resin, chlorine rubber, an epoxy resin, a pure or modified alkyd resin, polyethyl methacrylate, poly-n-butyl methacrylate, cellulose acetate, a ketone resin, polyethylene, polypropylene, polyacrylonitrile, a rosin derivative, polyvinylidene chloride, nitro cellulose, a phenol-formaldehyde resin, a methacresol-formaldehyde resin, a styrene-maleic anhydride copolymer, a polyacrylic acid-polyacrylic acid amide copolymer, a fumaric acid-ethylene glycol copolymer, a methyl vinyl ether-maleic anhydride copolymer, an acryloylglycine-vinyl acetate copolymer, polyvinyl pyrrolidone, polyvinyl alcohol, polyamide, halogenated styrene, and the like can be used. The amount of the intermediate layer coated is preferably in the range of from 0.01 to 10 g/m$^2$. If desired, electrically conductive inorganic salts may be added to the intermediate layer.

In preparing a lithographic printing plate using the electrophotographic print-making material of the present invention, conventionally known methods can be employed. In more detail, the photoconductive layer is uniformly charged by techniques such as the corona discharge method, and then exposed imagewise to form a charged image in an image pattern. Toners are attached to the charged area in the image pattern by a conventional dry or wet method, and then fixed by techniques such as heating. Then non-image areas with no toner attached thereto are made hydrophilic by treatment with a desensitizing liquid. As the desensitizing liquid, a composition containing ferrocyan or ferricyan compounds as described in U.S. Pat. No. 4,116,698, and a composition containing metal complex salts as described in U.S. Pat. No. 4,282,811 can be used. Using the lithographic printing plate thus prepared, offset printing is carried out by a conventional procedure, whereupon printed matter can be obtained which is excellent in pressure resistance, is easy to handle, and is less contaminated.

The plasma treatment of the present invention may be continuously carried out just after coating and drying of the photoconductive layer, or may be carried out independently from the coating and drying process.

The corona discharge treatment of the present invention may be carried out just after the photoconductive layer is coated on the electrically conductive support and dried, or after drying, the treatment may be applied as an independent step. After the electrophotographic platemaking process, that is, electridication, exposure, toner development and heat fixation, corona discharge treatment may be applied to increase densitization properties.

The flame treatment of the present invention may be carried out just after the photoconductive layer is coated on the electrically conductive support and dried, or after drying, the treatment may be applied as an independent step. As the combustion gas to be used in the flame treatment of the present invention, a mixed gas of paraffin or olefin hydrocarbon and oxygen is preferably used. As the hydrocarbon gas, any of methane, ethane, propane, butane, ethylene, propylene, or a mixture of two or more thereof can preferably be used. Moreover, in place of oxygen, a mixture of oxygen and incombustible gas such as nitrogen, or a mixture of oxygen and air can be used. In order to prevent an excessive increase in temperature in the flame treatment, it is preferred that the treatment be carried out while cooling the support in the condition that the back of the support is in contact with an inner water-cooling type of drum.

The present invention is described in greater detail with reference to the following examples. All percents and parts are by weight unless otherwise indicated.

EXAMPLE 1

| | |
|---|---|
| Photoconductive zinc oxide (SAZEX 2000, produced by Sakai Kagaku Kogyo Co., Ltd.) | 100 parts |
| Phthalic anhydride | 0.1 parts |
| Acryl resin (Daiyanal LR018, produced by Mitsubishi Rayon Co., Ltd.) | 50 parts |
| Rose Bengal (solid content: 2%; methanol solution) | 10 parts |
| Toluene | 90 parts |

The above ingredients were mixed and dispersed by the use of a supersonic dispersing machine to prepare a coating composition for a photoconductive layer. This coating composition was coated on a water-resistant electrophotographic base for preparation of a lithographic printing plate by the use of a wire bar in a dry coating amount of 20 g/m$^2$ and then dried. The material thus prepared was subjected to plasma surface treatment for 5 seconds under conditions of a degree of vacuum of $10^{-1}$ Torr, a frequency of 13.56 MHz and an output of 10 W by the use of a plasma treating machine. Then the material was allowed to stand in an air-conditioned (20° C.×60% RH) dark room for 24 hours for the purpose of dark adaptation. Using this material, a plate was produced with an electrophotographic print-making machine ELP404 (produced by Fuji Photo Film Co., Ltd.). This plate was passed once through an etching machine (produced by Ricoh Co., Ltd.) filled with an etching liquid ELP-E (composed of yellow prussitate of potash, ammonium primary phosphate and water,produced by Fuji Photo Film Co., Ltd.) to achieve desensitization, and then mounted on an off-set printing machine HAMADA Star 700CD (produced by Hamada Printing Machine Co., Ltd.). 3,000 sheets of paper were printed with magenta ink (LK500 Magenta,-produced by Toyo Ink Co., Ltd.). Printed matter was obtained which was entirely free from ground contamination and spot contamination. In addition, other defects such as a short press life trouble were not observed at all.

COMPARATIVE EXAMPLE 1

The procedure of Example 1 was repeated wherein the plasma treatment was not applied. In order to compare the sample thus prepared with that of Example 1 with respect to contamination, the desensitization treatment was conducted using an etching liquid (as such in Run No. 1, and forcedly deteriorated by diluting with water to 2 and 4 times in Run Nos. 2 and 3, respectively). Then 3,000 sheets of paper were printed with black ink (Bright Black produced by Toyo Ink Co., Ltd.). The results are shown in Table 1. It can be seen that the plasma treatment of Example 1 greatly improves print contamination.

TABLE 1

| Comparation of Sample of Comparative Example 1 and Sample of Example 1 with respect to Contamination | | | |
|---|---|---|---|
| | | Sample | |
| Run No. | Etching Liquid | Example 1 Plasma Treatment | Comparative Example 1 No Plasma Treatment |
| 1 | Original liquid | A | A |
| 2 | 2-Time diluted | A | B |
| 3 | 4-Time diluted | A | X |

"A" represents that Sample shows neither ground contamination nor spot contamination after printing of 3,000 sheet.

"B" represents that Sample shows a slight ground contamination after printing of 1,000 sheets.

"X" represents that contamination occurred at the 500th paper.

EXAMPLE 2

A subbing liquid having the composition shown below was coated on a 0.15 mm thick aluminum plate by the use of a wire bar in a dry coating amount of 3 g/m$^2$ and then dried.

| Composition of Subbing Liquid | |
|---|---|
| Polyamide resin (Ultraamide IC produced by BASF) | 100 parts |
| Methanol silica dispersion (solid contents: 30%; produced by Nissan Kagaku Co., Ltd.) | 100 parts |
| Methanol | 400 parts |

On the subbing layer as prepared above, a photoconductive layer of the same composition as in Example 1 was coated in a dry coating amount of 25 g/m$^2$ and then dried. The sample thus prepared was subjected to plasma treatment for 10 seconds under conditions of a degree of vacuum of 0.3 Torr, a frequency of 30 KHz and an output of 2,000 W. After dark adaptation, a plate was produced. Desensitization treatment was conducted using the 2 time-diluted etching liquid as used in Comparative Example 1. Then 30,000 sheets of paper were printed with black ink (Bright Black produced by Toyo Ink Co., Ltd.). Good printed matter entirely free from contamination was obtained.

COMPARATIVE EXAMPLE 2

The procedure of Example 2 was repeated wherein the plasma treatment was not applied. At the 2,000th sheet of paper, ground contamination was formed on the entire surface.

EXAMPLE 3

| | |
|---|---|
| Photoconductive zinc oxide (SAZEX 2000 produced by Sakai Kagaku Kogyo Co., Ltd.) | 100 parts |
| Phthalic anhydride | 0.1 parts |
| Acryl resin (Daiyanal LR018 produced by Mitsubishi Rayon Co., Ltd.; solid content: 40%) | 50 parts |
| Rose Bengal (2% methanol solution) | 10 parts |
| Toluene | 90 parts |

The above ingredients were dispersed for 20 minutes by the use of a supersonic dispersing machine to produce a coating composition for a photoconductive layer. This coating composition was coated on a water-resistant electrophotographic base in a dry coating amount of 20 g/m$^2$ by the use of a wire bar and then dried. The sample thus produced was subjected to corona discharge treatment under conditions of 5 KV.A.-sec/m$^2$ and then allowed to stand in an air-conditioned (20° C.×60% RH) dark room for 24 hours for the purpose of dark adaptation. Using this sample, a print was produced with an electrophotographic plate-making machine, and etching machine filled with an etching liquid, as in Example 1 to achieve desensitization. The printing plate thus processed was mounted on an offset printing machine as in Example 1, and 3,000 sheets of paper were printed with cyan ink (Bright Cyan produced by Toyo Ink Co., Ltd.). Good printed matter entirely free from ground contamination and spot contamination was obtained. Other defects such as a spot press life trouble were not observed at all.

COMPARATIVE EXAMPLE 3

The procedure of Example 3 was repeated, except that the corona discharge treatment was not applied. In order to compare the sample thus prepared with that of Example 3 with respect to contamination, desensitization was conducted using an etching liquid (as such in Run No. 1, and diluted with water to 2 and 4 times in Run Nos. 2 and 3, respectively). Then 3,000 sheets of paper were printed with black ink (Bright Black produced by Toyo Ink Co., Ltd.). The results are shown in Table 1. It can be seen that the corona discharge treatment of Example 3 greatly improves resistance to print contamination.

TABLE 2

| Comparison with respect to Contamination | | | |
|---|---|---|---|
| Run No. | Etching Liquid | Example 5 (Corona Discharge Treatment) | Comparative Example 3 (No Corona Discharge Treatment) |
| 1 | Original liquid | A | A |
| 2 | 2-Time diluted | A | B |
| 3 | 4-Time diluted | A | X |

"A" represents that Sample shows neither ground contamination nor spot contamination after printing of 3,000 sheets.

"B" represents that Sample shows a slight ground contamination after printing of 1,000 sheets.

"X" represents that contamination occurred at the 500th paper.

EXAMPLE 4

A printing plate produced in the same manner as in Comparative Example 3 was subjected to corona discharge treatment under conditions of 5 KV.A.sec/m$^2$, and then to desensitization using a 4-time diluted etching liquid as used in Comparative Example 1. Then 3,000 sheets of paper were printed with magenta ink (LK500 Magenta produced by Toyo Ink Co., Ltd.). Good printed matter entirely free from contamination was obtained.

EXAMPLE 5

A subbing liquid having the composition shown below was coated on a 0.15 mm thick aluminum plate in a dry coating amount of 3 g/m$^2$ and then dried.

| Composition of Subbing Liquid | |
|---|---|
| Polyamide resin (Ultraamide TC produced by BASF) | 100 parts |
| Methanol silica dispersion (solid contents: 30%; produced by Nissan Kagaku Co., Ltd.) | 100 parts |
| Methanol | 400 parts |

On the subbing layer thus prepared, a photoconductive layer having the same composition as in Example 3 was coated in a dry coating amount of 25 g/m$^2$ and then dried. The sample thus prepared was subjected to corona discharge treatment under conditions of 7 KV.A.-sec/m$^2$, and then, after dark adaptation, a plate was produced. This plate was subjected to desensitization treatment using the same 2-time diluted etching liquid as used in Comparative Example 3. Then 30,000 sheets of paper were printed with black ink (Bright Black produced by Toyo Ink Co., Ltd.). Good printed matter completely free from contamination was obtained.

EXAMPLE 6

| | |
|---|---|
| Photoconductive zinc oxide (SAZEX 2000 produced by Sakai Kagaku Co., Ltd.) | 100 parts |
| Phthalic anhydride | 0.1 parts |
| Acryl resin (Daiyanal LR018 produced by Mitsubishi Rayon Co., Ltd.) | 50 parts |
| Rose Bengal (2% methanol solution) | 10 parts |
| Bromophenol Blue (2% meth and solution) | 3 parts |
| Toluene | 90 parts |

The above ingredients were dispersed by the use of a supersonic discharging machine to prepare a coating composition for a photoconductive layer. This coating composition was coated on a water-resistant electrophotographic base in a dry coating amount of 20 g/m$^2$ by the use of a wire bar and then dried. While running at a speed of 80 m/min, the sample was subjected to flame surface treatment using combustion gas having the composition shown below.

Composition of Combustion Gas A

Propane: 26 g/cm/hr

Oxygen: 240 g/cm/hr (The consumption amount indicated is per a width of 1 cm of a flame discharge outlet of the burner and per a time of 1 hour).

This sample was subjected to dark adaptation for 24 hours in a dark room at 20° C. and 60% RH. A printing plate was produced with an electrophotographic plate-making machine and then subjected to desensitization treatment using an etching liquid ELP-E as in Example 1. Printing was conducted using magenta ink (LK500 Magenta produced by Toyo Ink Co., Ltd.). More than 3,000 sheets of paper were obtained without any spot-like contamination. Defects such as a short press life trouble were not observed at all.

COMPARATIVE EXAMPLE 4

The procedure of Example 6 was repeated, except that the flame treatment was not applied. When 500 sheets of paper were printed, ground contamination was formed.

EXAMPLE 7

A subbing liquid having the composition shown below was coated on a 0.15 mm thick aluminum plate in a dry coating amount of 3 g/m$^2$, and then dried.

| Composition of Subbing Liquid | |
|---|---|
| Polyamide resin (Ultraamide IC produced by BASF) | 100 parts |
| Methanol silica dispersion (solids content: 30%; produced by Nissan Kagaku Co., Ltd.) | 100 parts |
| Methanol | 400 parts |

On the subbing layer thus formed, a photoconductive layer of the same composition as in Example 6 was coated in a dry coating amount of 25 g/m$^2$ and then dried. This sample was subjected to flame treatment using a flame of gas composition B while running the sample at a speed of 100 m/min.

Composition of Combustion Gas B

Propane: 12 g/cm/hr

Butane: 8 g/cm/hr

Oxygen: 140 g/cm/hr

After dark adaptation, printing was conducted using magenta ink in the same manner as in Example 6. More than 30,000 sheets of paper were printed satisfactorily.

EXAMPLE 8

| | |
|---|---|
| Photoconductive zinc oxide (SAZEX 2000 produced by Sakai Kagaku Kogyo Co., Ltd.) | 100 parts |
| Acryl resin (Daiyanal LR018 produced by Mitsubishi Rayon Co., Ltd.) | 50 parts |
| Rose Bengal (2% methanol solution) | 10 parts |
| Toluene | 90 parts |

The above ingredients were mixed and dispersed with a supersonic dispersing machine for 20 minutes to prepare a coating composition for a photoconductive layer. This coating composition was coated on a water-resistant electrophotographic base in a dry coating amount of 20 g/m$^2$ and then dried. The sample thus prepared was irradiated with an electron beam at an acceleration voltage of 200 KV in such a manner that the absorption dose was 5 Mrad. This sample was allowed to stand for 24 hours in an air-conditioned (20° C.×60% RH) dark room. A printing plate was produced with an electrophotographic plate-making machine ELP280 (produced by Fuji Photo Film Co., Ltd.). This plate was subjected to desensitization treatment by passing it through an etching machine (produced by Ricoh Co., Ltd.) filled with an etching liquid (produced by Fuji Photo Film Co., Ltd.) and then mounted on an off-set printing machine Hamada Star 700CD (produced by Hamada Printing Machine Co., Ltd.). Printing was conducted using magenta Ink (produced by Toyo Ink Co., Ltd.). More than 3,000 sheets of paper were obtained with no ground contamination and no spot-like contamination.

COMPARATIVE EXAMPLE 5

A printing plate was produced in the same manner as in Example 8 except that the electron beam treatment was not applied. In order to compare the sample thus produced with that of Example 8 with respect to contamination, the sample was subjected to desensitization treatment using a fresh etching liquid or a fatigued etching liquid used in processing of 500 editions. Then 3,000 sheets of paper were printed using Black Ink. The results are shown in Table 3. It can be seen that the electron beam irradiation treatment more significantly reduces print contamination.

TABLE 3

| Comparison of Contamination | | | |
|---|---|---|---|
| Run No. | Etching Liquid | Example 8 (Electron beam Irradiation) | Comparative Example 5 (No electron beam irradiation) |
| 1 | Fresh liquid | A | A |
| 2 | Fatigued liquid | A | X |

"A" represents that Sample shows neither ground contamination nor spot contamination after printing of 3,000 sheets.

"X" represents that contamination occurred at the 500th paper.

EXAMPLE 9

A subbing liquid having the composition shown below was coated on a 0.15 mm thick aluminum plate in a dry coating amount of 3 g/m$^2$ and then dried.

| Composition of Subbing Liquid | |
|---|---|
| Polyamide resin (Ultraamide IC produced by BASF) | 100 parts |
| Methanol silica dispersion (solid content: 30%; produced by Nissan Kagaku Co., Ltd.) | 100 parts |
| Methanol | 400 parts |

On the subbing layer thus formed, a photoconductive layer having the same composition as in Example 8 was coated in a dry coating amount of 25 g/m$^2$ and then dried. The sample thus produced was subjected to ion beam irradiation treatment under conditions of an ion acceleration voltage of 500 V, an ion density of 0.3 mA/cm$^2$ and an irradiation time of 10 seconds. After dark adaptation, a plate was produced. This printing plate was subjected to desensitization treatment using the same fatigued etching liquid as used in Comparative Example 5. Printing was conducted using Black Ink. More than 30,000 sheets of paper with no contamination were obtained.

COMPARATIVE EXAMPLE 6

A printing plate was produced in the same manner as in Example 9, except that the ion beam irradiation treatment was not applied. This printing plate was desensitized with the same fatigued etching liquid as used in Example 9. Printing was conducted. At the 1,000th sheet, contamination occurred.

EXAMPLE 10

In place of ion beam irradiation treatment in Example 9, neutral particle beam irradiation treatment was conducted under conditions of a particle acceleration voltage of 5,000 V, a neutral particle beam density of 0.03 mA/cm$^2$, and an irradiation time of 60 seconds. After dark adaptation, a printing plate was produced. This plate was subjected to desensitization treatment using the same fatigued etching liquid as was used in Comparative Example 5. Printing was conducted using Black Ink. More than 30,000 sheets of paper with no contamination were obtained.

EXAMPLE 11

| | |
|---|---|
| Photoconductive zinc oxide (SAZEX 2000 produced by Sakai Kagaku Co., Ltd.) | 100 parts |
| Acryl resin (Daiyanal LR018 produced by Mitsubishi Rayon Co., Ltd.) | 60 parts |
| Rose Bengal (solid content: 2%; methanol solution) | 10 parts |
| Toluene | 90 parts |

The above ingredients were mixed and dispersed for 20 minutes by the use of a supersonic wave dispersing machine to prepare a coating composition for a photoconductive layer. This coating composition was coated on a water-resistant electrophotographic base in a dry coating amount of 20 g/m$^2$ and then dried. This sample was subjected to plasma treatment for varied times under conditions of a degree of vacuum of $10^{-1}$ Torr, a frequency of 13.56 MHz and an output of 10 W by the use of a plasma treatment machine to produce Samples B to G. Untreated sample A and the samples 3 to G were each measured for a degree of exposure of zinc oxide by ESCA. For printing testing, each sample was allowed to stand for 24 hours in an air-conditioned (20° C., 60% RH) room in a dark place for the purpose of dark adaptation. Then a printing plate was produced with an electrophotographic plate-making machine ELP404 (produced by Fuji Photo Film Co., Ltd.). After desensitization treatment, printing was conducted using magenta ink (LK500 Magenta produced by Toyo Ink Co., Ltd.). The results are shown in Table 4. If the degree of exposure exceeded 10%, resistance to print contamination was improved. Particularly when the degree of exposure was more than 15%, contamination was completely prevented. On the other hand, if the degree of exposure exceeded 70%, a drop in press life was observed.

TABLE 4

| Sample | Degree of Exposure of Zinc Oxide in the Surface (%) | Print Contamination Evaluation | Press Life |
|---|---|---|---|
| A | 6 | Contamination occurred at the 100th sheet | 3,000 sheets of paper could be printed. |
| B | 10 | Contamination occurred at the 500th sheet | 3,000 sheets of paper could be printed |
| C | 16 | No contamination occurred even after 3,000 sheets were printed | (same as above) |
| D | 25 | (same as above) | (same as above) |
| E | 48 | (same as above) | (same as above) |
| F | 69 | (same as above) | Image drop out partially occurred at the 500th sheet |
| G | 83 | (same as above) | Image drop out wholly occurred at the 50th Sheet |

EXAMPLE 12

Electrophotographic printing plates H and I were produced in the same manner as in Example 11 except that the amount of the acryl resin used was changed to 50 parts and 40 parts, respectively. These plates were measured for the degree of exposure of zinc oxide in the surface and contamination. The results were shown in Table 5. It can be seen that contamination properties were significantly improved when the degree of exposure was more than 10%, and particularly when it was more than 15%.

TABLE 5

| | Sample | | |
|---|---|---|---|
| | A | H | I |
| Degree of Exposure of Zinc Oxide (%) | 6 | 12 | 18 |
| Print Contamination Evaluation | Contamination occurred at the 100th sheet | No contamination occurred until 2,000 sheets of paper were printed | No contamination occurred until 3,000 sheets of paper were printed |
| Press Life | 3,000 sheets of paper could be printed | 3,000 sheets of paper could be printed | 3,000 sheets of paper could be printed |

In accordance with the present invention, a large number of printed copies can be obtained with no ground contamination.

While the invention has been described in detail and with reference to specific embodiments thereof, it will be apparent to one skilled in the art that various changes and modification can be made therein without departing from the spirit and scope thereof.

What is claimed is:

1. An electrophotographic lithographic printing plate comprising an electrically conductive support and a photoconductive layer on the support, said photoconductive layer being made mainly of a photoconductive zinc oxide and a non-crosslinkable resin binder which does not contain ethylenic double bonds which if present would render the resin radiation curable, wherein in the surface of the photoconductive layer, the degree of exposure of photoconductive zinc oxide is regulated to be from 10% to 70% by subjecting the photoconductive layer to plasma treatment, corona discharge treatment, flame treatment, electron beam treatment of ion beam treatment.

2. An electrophotographic lithographic printing plate as in claim 1, wherein the degree of exposure of the photoconductive zinc oxide is regulated to be from 15 to 70%.

3. An electrophotographic lithographic printing plate as in claim 1, wherein the surface of the photoconductive layer is subjected to plasma treatment.

4. An electrophotographic lithographic printing plate as in claim 1, wherein the plasma treatment is a low pressure glow discharge plasma treatment.

5. An electrophotographic lithographic printing plate as in claim 1, wherein the surface of the photoconductive layer is subjected to corona discharge treatment.

6. An electrophotographic lithographic printing plate as in claim 1, wherein the surface of the photoconductive layer is subjected to flame treatment.

7. An electrophotographic lithographic printing plate as in claim 1, wherein the surface of the photoconductive layer is subjected to electron beam or ion beam irradiation treatment.

8. An electrophotographic lithographic printing plate as in claim 1, wherein the weight ratio of the photoconductive zinc oxide to the resin binder is from 3/1 to 20/1.

9. An electrophotographic lithographic printing plate as in claim 2, wherein the weight ratio of the photoconductive zinc oxide to the resin binder is from 3/1 to 20/1.

10. An electrophotographic lithographic printing plate as in claim 3, wherein the weight ratio of the photoconductive zinc oxide to the resin binder is from 3/1 to 20/1.

11. An electrophotographic lithographic printing plate as in claim 5, wherein the weight ratio of the photoconductive zinc oxide to the resin binder is from 3/1 to 20/1.

12. An electrophotographic lithographic printing plate as in claim 6, wherein the weight ratio of the photoconductive zinc oxide to the resin binder is from 3/1 to 20/1.

13. An electrophotographic lithographic printing plate as in claim 7, wherein the weight ratio of the photoconductive zinc oxide to the resin binder is from 3/1 to 20/1.

14. An electrophotographic lithographic printing plate as in claim 1, wherein an intermediate layer is provided between the electrically conductive support and the photoconductive layer.

15. An electrophotographic lithographic printing plate as in claim 2, wherein an intermediate layer is provided between the electrically conductive support and the photoconductive layer.

16. An electrophotographic lithographic printing plate as in claim 14, wherein the intermediate layer is coated in the range of from 0.01 to 10 $g/m^2$.

17. An electrophotographic lithographic printing plate as in claim 15, wherein the intermediate layer is coated in the range of from 0.01 to 10 $g/m^2$.

18. An electrophotographic lithographic printing plate as in claim 1, wherein said resin binder is selected from the group consisting of silicone resin, polystyrene, polyacrylate or polymethacrylate, polyvinyl acetate, polyvinyl chloride and polyvinyl butyral.

19. An electrophotographic lithographic printing plate as in claim 1, wherein said resin binder is selected from the group consisting of polyacrylate or polymethacrylate.

* * * * *